US008267244B2

(12) United States Patent
Dunn et al.

(10) Patent No.: US 8,267,244 B2
(45) Date of Patent: Sep. 18, 2012

(54) PACKAGED GATE SYSTEMS AND METHOD OF DISPLAY

(76) Inventors: Steven B. Dunn, Beverly Hills, CA (US); Christopher J. Harrelson, Long Beach, CA (US)

( * ) Notice: Subject to any disclaimer, the term of this patent is extended or adjusted under 35 U.S.C. 154(b) by 168 days.

(21) Appl. No.: 12/790,149

(22) Filed: May 28, 2010

(65) Prior Publication Data

US 2011/0289852 A1 Dec. 1, 2011

(51) Int. Cl.
*B65D 71/00* (2006.01)

(52) U.S. Cl. ..... 206/223; 206/781; 206/775

(58) Field of Classification Search ..... 206/223, 206/781, 779, 780, 777, 778, 776, 462, 463, 206/468, 471, 461, 769, 583; 49/460, 507; 229/117.3, 162.3, 162.7
See application file for complete search history.

(56) References Cited

U.S. PATENT DOCUMENTS

| | | | | | |
|---|---|---|---|---|---|
| 3,487,915 | A | * | 1/1970 | Scott | 206/461 |
| 3,946,870 | A | | 3/1976 | Gajer et al. | |
| D244,355 | S | | 5/1977 | Mazie et al. | |
| D249,639 | S | | 9/1978 | Hogg et al. | |
| 4,542,822 | A | * | 9/1985 | Kennedy et al. | 220/602 |
| 4,739,353 | A | * | 4/1988 | Heuer et al. | 206/316.2 |
| 4,848,577 | A | * | 7/1989 | Hoffman et al. | 206/467 |
| 5,219,073 | A | | 6/1993 | Cowie | |
| 5,285,901 | A | * | 2/1994 | Huang | 206/521 |
| 5,372,250 | A | | 12/1994 | Johnson | |
| 5,413,217 | A | | 5/1995 | Sauer | |
| D360,358 | S | | 7/1995 | Steinfels, III | |
| 5,435,447 | A | | 7/1995 | Weatherford et al. | |
| 5,447,230 | A | * | 9/1995 | Gerondale | 206/363 |
| 5,871,099 | A | | 2/1999 | Mellenthin et al. | |
| 5,890,593 | A | | 4/1999 | Humphrey | |
| D433,941 | S | | 11/2000 | Kelsey | |
| 6,213,334 | B1 | | 4/2001 | Coelho et al. | |
| D485,171 | S | | 1/2004 | Chandaria | |
| D497,804 | S | * | 11/2004 | Hetzel et al. | D9/418 |
| D513,595 | S | * | 1/2006 | Weber et al. | D9/709 |
| D534,419 | S | * | 1/2007 | Hermkens et al. | D9/418 |
| D535,193 | S | | 1/2007 | Rutledge | |
| 7,281,630 | B2 | * | 10/2007 | Hartman et al. | 206/467 |
| 7,334,624 | B2 | * | 2/2008 | Waldman et al. | 160/144 |
| D610,000 | S | * | 2/2010 | Schantz | D9/418 |
| 2005/0183978 | A1 | | 8/2005 | Christensen et al. | |
| 2009/0293363 | A1 | * | 12/2009 | Flannery | 49/55 |

* cited by examiner

*Primary Examiner* — Steven A. Reynolds
(74) *Attorney, Agent, or Firm* — Robert Z. Evora, Esq.

(57) ABSTRACT

A packaged gate system includes a gate and a box having an interior space in which the gate is positioned. The box has front and rear major surfaces, a bottom surface, a top surface and a side surface that defines an edge of the box. An opening is defined in an uppermost portion of the side surface, a portion of the top surface and a portion of at least one of the front and rear major surfaces. A transparent insert is positioned in the opening and is secured to at least one of the box and a portion of the gate, The portion of the gate, which may include a connector assembly, will be visible to a consumer when the packaged gate system is stacked edgewise together with like packaged gate systems on the bottom surface with the side surface facing the consumer. The insert may also be configured to define a gripping handle that a consumer may use to pull the packaged gate system outwardly in order to extract it from the stack.

27 Claims, 7 Drawing Sheets

PACKAGED GATE SYSTEMS AND METHOD OF DISPLAY

BACKGROUND OF THE INVENTION

1. Field of the Invention

This invention relates generally to the packaging and retail display of consumer gate systems, which for purposes of this document is defined as fences, gates and barriers, such as those that are used to prevent small children from wandering into dangerous areas.

2. Description of the Related Technology

Consumer gate systems such as fences, gates and barriers are used in households as well as institutions such as day care centers for such purposes as preventing small children and pets from wandering into dangerous areas such as stairways, and to keep pets confined to desired areas within a building.

Many different types of consumer gate systems are commercially available. Some consumer gate systems are designed to be mounted within a doorway using a compression or interference fit. Others are designed to be permanently mounted using fixation devices such as brackets and screws. Some consumer gate systems include a pivoting movable gate that is attached to a frame using a hinge assembly. Others are designed to fold or collapse. Still others are simply a fixed barrier. For purposes of this document, the word "gate" will be defined as including all types of consumer gate systems as well as equivalent systems that are designed for use in commercial and institutional settings.

Consumer gate systems tend to be packaged in large cardboard boxes for shipping and retail purposes. Because of the inherent shape and size of the product, such boxes tend to have large, substantially planar front and rear major surfaces and relatively narrow top, bottom and side surfaces. In order to conserve valuable retail space, the boxes are typically stacked edgewise, with the major surfaces in contact with each other, on a horizontal surface such as a shelf or the floor of a retail facility, which leaves only one of the side surfaces visible to a consumer who is in the adjacent aisle.

Unfortunately, the extremely limited size of the exposed visible side surface has made it difficult for manufacturers and retailers to communicate sufficient information to the consumer that may be relevant to his or her decision-making process. Typically, a label or printed laminated coating has been applied to the visible surface that may include a brief description and a small thumbnail sketch of the product. Unfortunately, the consumer is often left guessing about many aspects of the product, such as the principle of operation, the general robustness and quality of the product and the materials that are used to manufacture the product, until after it is purchased and taken out of the cardboard box.

Consumer gate systems also tend to be relatively large, and may be awkward and heavy for some consumers to pick up and handle. When they are stacked together edgewise or on top of each other with a plurality of like products, it is often difficult for consumers to pull them outwardly in order to extract them from the stack and place them on a shopping cart. This may even deter some customers from purchasing a given item.

A need exists for a packaged gate system that better informs the consumers as to the nature of the system when a plurality of like systems are stacked together within a retail establishment. A need also exists for a packaged gate system that is more convenient for consumers to grasp and handle, both while shopping and while transporting the system to its final location of intended use.

SUMMARY OF THE INVENTION

Accordingly, it is an object of the invention to provide a packaged gate system that better informs the consumers as to the quality and nature of the system when like products are stacked together within a retail establishment.

It is another object of the invention to provide a packaged gate system that is more convenient for consumers to grasp and handle, both while shopping and when transporting the system to its final location of intended use.

In order to achieve the above and other objects of the invention, a packaged gate system according to one aspect of the invention includes a gate and a box that defines an interior space in which the gate is positioned. The box has front and rear major surfaces and at least one side surface that defines an edge of the box. The side surface has a first maximum width, and an opening is defined in the side surface. An insert is positioned in the opening and is secured to at least one of the box and the gate. The insert has a second maximum width that is less than the first maximum width, whereby a space is defined to permit a consumer to grasp and move the packaged gate system.

A packaged gate system according to a second aspect of the invention also includes a gate and a box that defines an interior space in which the gate is positioned. The box has front and rear major surfaces and at least one side surface that defines an edge of the box. An opening is defined in the side surface and a transparent insert is positioned in the opening. The insert is secured to a portion of the gate, whereby the portion of the gate is visible to a consumer when the packaged gate system is stacked edgewise with the side surface facing the consumer.

A packaged gate system according to a third aspect of the invention includes a gate and a box defining an interior space in which the gate is positioned. The box has front and rear major surfaces, a bottom surface, a top surface and a side surface that defines an edge of the box. An opening is defined in an uppermost portion of the side surface, a portion of the top surface and a portion of at least one of the front and rear major surfaces. A transparent insert is positioned in the opening, and the insert is secured to at least one of the box and a portion of the gate, whereby the portion of the gate will be visible to a consumer when the packaged gate system is stacked edgewise together with like packaged gate systems on the bottom surface with the side surface facing the consumer.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
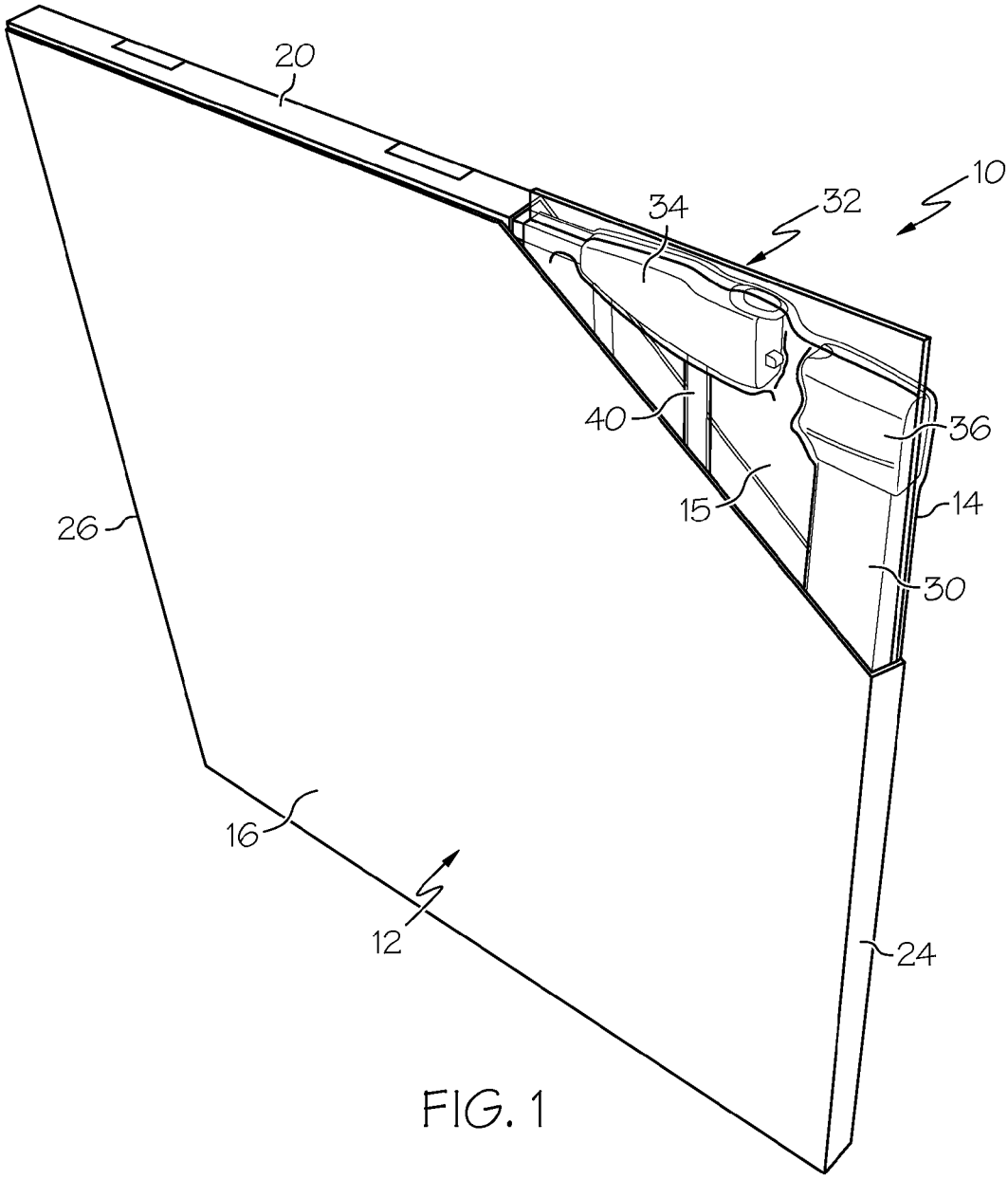
FIG. 1 is a perspective view of a packaged gate system that is constructed according to a preferred embodiment of the invention.

Referring now to the drawings, wherein like reference numerals designate corresponding structure throughout the views, and referring in particular to FIG. 1, a packaged gate system 10 that is constructed according to a preferred embodiment of the invention includes a box 12. Box 12 is preferably fabricated from a material such as cardboard, but it could alternatively be constructed out of any type of material that would protect the contents during shipping and retail display.

Cardboard box 12 defines an interior space in which a gate 14 is positioned. Gate 14 could be any type of consumer gate system, as that term has previously been defined, including systems that are designed for use in residential, commercial or institutional settings.

In the preferred embodiment, gate 14 includes a rigid vertical side post or column 30 on a first side thereof, a top horizontal bar 38 and a plurality of vertical posts or slats 40, all of which are preferably fabricated from a metallic material such as steel or aluminum that has a powdered enamel coating. Alternatively, one or more of these elements may be fabricated from a material such as wood, plastic or a composite material.

A connecting mechanism 32, such as a latching assembly having a first connector component 34 that is integral with the horizontal bar 38 and a second connector component 36 that is integral with the vertical side column 30, may be provided for releasably securing and unsecuring respective portions of the gate 14 to each other. The connecting mechanism 32 could alternatively be a handle or a hinge assembly that permanently attaches one portion of the gate 14 to another portion.

In the preferred embodiment, cardboard box 12 has six sides, with each side being substantially rectangular in shape, notwithstanding the presence of an opening 15 that will be described in greater detail below. It includes a major front surface 16 and a major rear surface 18 that are the largest of the six sides. The front and rear surfaces 16, 18 are preferably substantially identical in size and shape and are disposed in respective planes that are substantially parallel to each other. They may be shaped so as to be substantially square. In the preferred embodiment, each of the front and rear surfaces 16, 18 has a surface area that is at least about 3 $ft.^2$, more preferably at least 4 $ft.^2$ and most preferably at least 7 $ft.^2$.

Cardboard box 12 further includes a top surface 20, a bottom surface 22, a first side surface 24 and a second side surface 26. Each of the surfaces 20, 22, 24, 26 is preferably shaped as an elongated rectangle, having a length that is substantially greater than its width. Preferably, a ratio of length to width for each of the surfaces 20, 22, 24, 26 is at least about 4.0, more preferably at least about 6.0 and most preferably at least about 8.0. Each of the surfaces 20, 22, 24, 26 preferably has a surface area that is less than about 0.8 $ft.^2$, more preferably less than about 0.6 $ft.^2$ and most preferably less than about 0.4 $ft.^2$. Accordingly, the cardboard box 12 preferably has top, bottom and side surfaces that are much thinner than the front and rear surfaces and thereby define edges of the cardboard box 12, giving the cardboard box 12 a generally planar slab-like shape.

The top and bottom surfaces 20, 22 are preferably disposed in respective planes that are substantially parallel to each other Likewise, the first and second side surfaces 24, 26 are preferably disposed in respective planes that are substantially parallel to each other.

Figure 3:
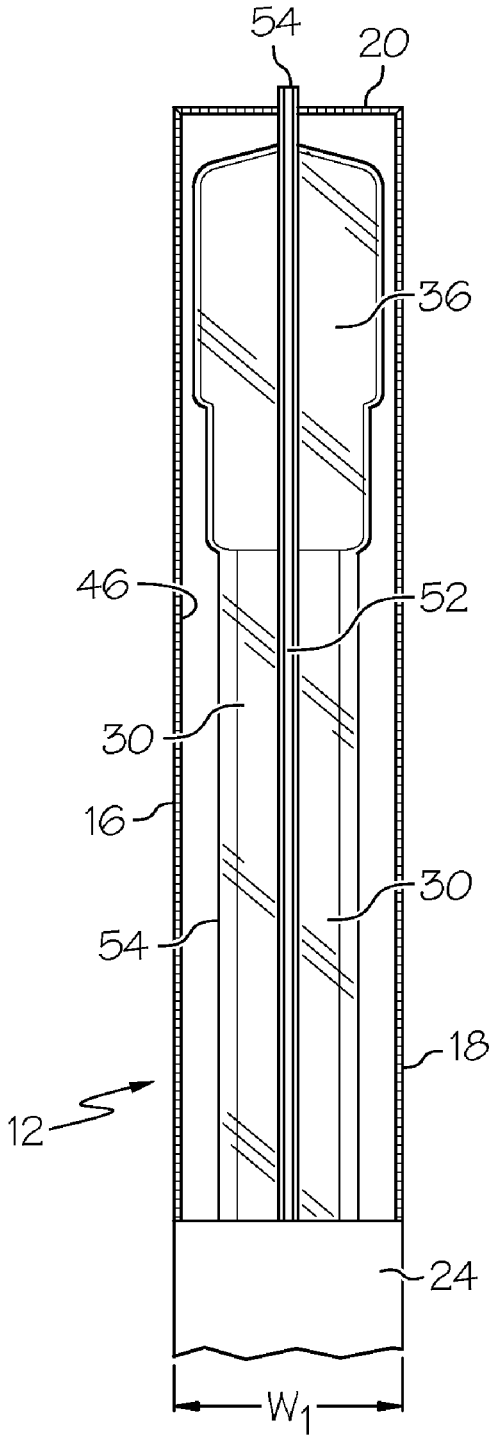
FIG. 3 is a fragmentary side elevational view of a portion of the packaged gate system that is shown in FIG. 1.

Referring briefly to FIG. 3, it will be seen that the first side surface 24 defines one edge of the cardboard box 12, which is intended to face the consumer when displayed for retail. The first side surface 24 has a first maximum width $W_1$ that is preferably substantially within a range of about 0.5 inch to about 6 inches, more preferably within a range of about 1 inch to about 4 inches, and most preferably within a range of about 1.25 inch to about 2.5 inches.

Figure 2:
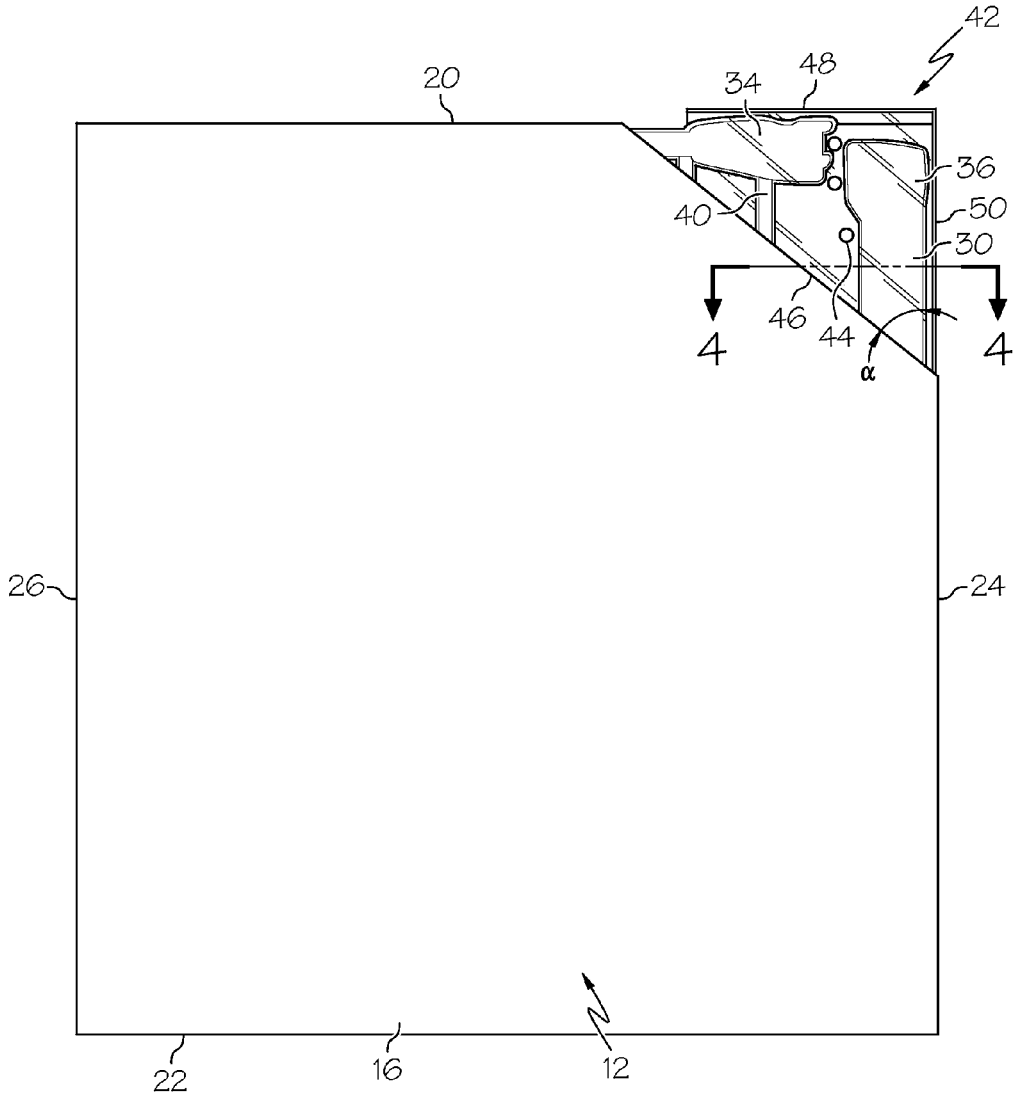
FIG. 2 is a front elevational view of the packaged gate system that is shown in FIG. 1.

As may best be seen in FIGS. 1 and 2, an opening 15 is defined in the cardboard box 12. In the preferred embodiment, opening 15 is defined in a corner of the cardboard box 12, in portions of the panel forming the front surface 16, the panel forming the rear surface 18, the panel forming the top surface 20 and an uppermost portion of the panel forming the first side surface 24. The panel forming the front surface 16 and the panel forming the rear surface 18 in the preferred embodiment each have an angled edge surface 46 extending between the top surface 20 in the first side surface 24. In the preferred embodiment, the angled edge surface 46 forms an angle $\alpha_1$ with respect to the vertical first side surface 24 that is preferably within a range of about 20° to about 70°, more preferably within a range of about 30° to about 60°, and most preferably within a range of about 40° to about 50°.

Alternatively, the edge surface 46 could be curved, or shaped as a combination of curves and straight lines. Preferably, however it is a substantially straight edge. One benefit of a straight edge is that the cardboard material could be folded back at the edge to provide reinforcement.

Alternatively, the opening 15 could be defined in only the first side surface 24, or in only one of the front and rear surfaces 16, 18 and the first side surface 24.

According to one advantageous feature of the preferred embodiment, an insert 42 is positioned within the opening 15 and is preferably secured to at least one of the cardboard box 16 and the gate 14. In the preferred embodiment, the insert 42 is molded so as to conform to features of portions of the gate 14, folded over and attached to itself so as to be secured to the gate 14, and it is not directly secured to the cardboard box 12. However, it could alternatively be constructed so that it is secured to the cardboard box 12 and not directly secured to the gate 14, or so that it is secured to both the cardboard box 12 and the gate 14.

Insert 42 is preferably fabricated from a transparent plastic material such as polyvinyl chloride (PVC), so as to permit a consumer to view features of the gate 12 that would otherwise be invisible. More specifically, the transparency of the portion of the insert 42 that forms part of the first side surface 24 of the packaged gate system 10 permits a consumer to view features of the gate 12 even when the packaged gate system 10 is stacked edgewise together with a plurality of other similar packaged gate systems 10, with the first side surface 24 facing the consumer. Accordingly, the consumer will not have to rely upon printed information on the outside of the cardboard box 12 in order to ascertain details of the features that are made visible by the transparency of the insert 42.

Figure 4:
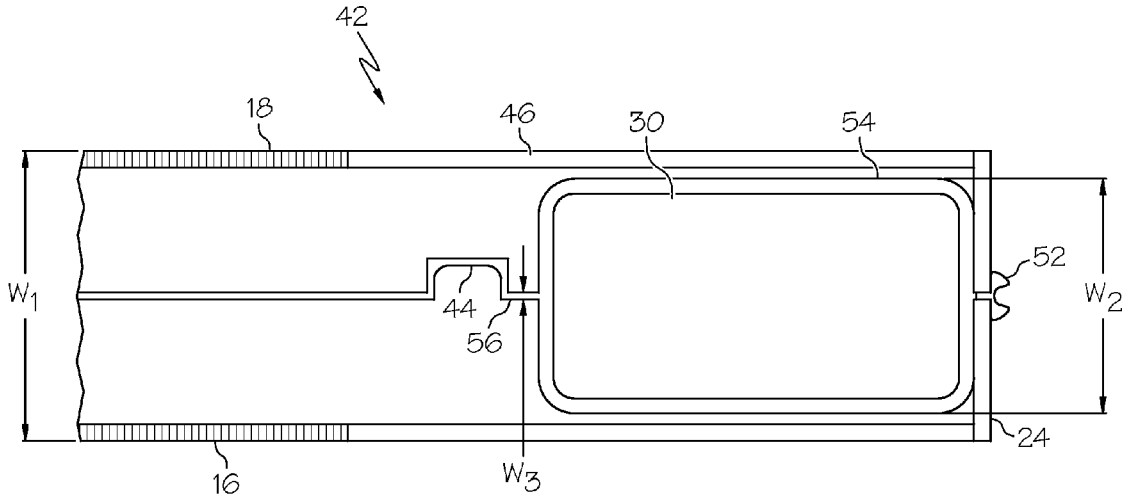
FIG. 4 is a fragmentary cross-sectional view taken along lines 4-4 in FIG. 2.
Figure 5:
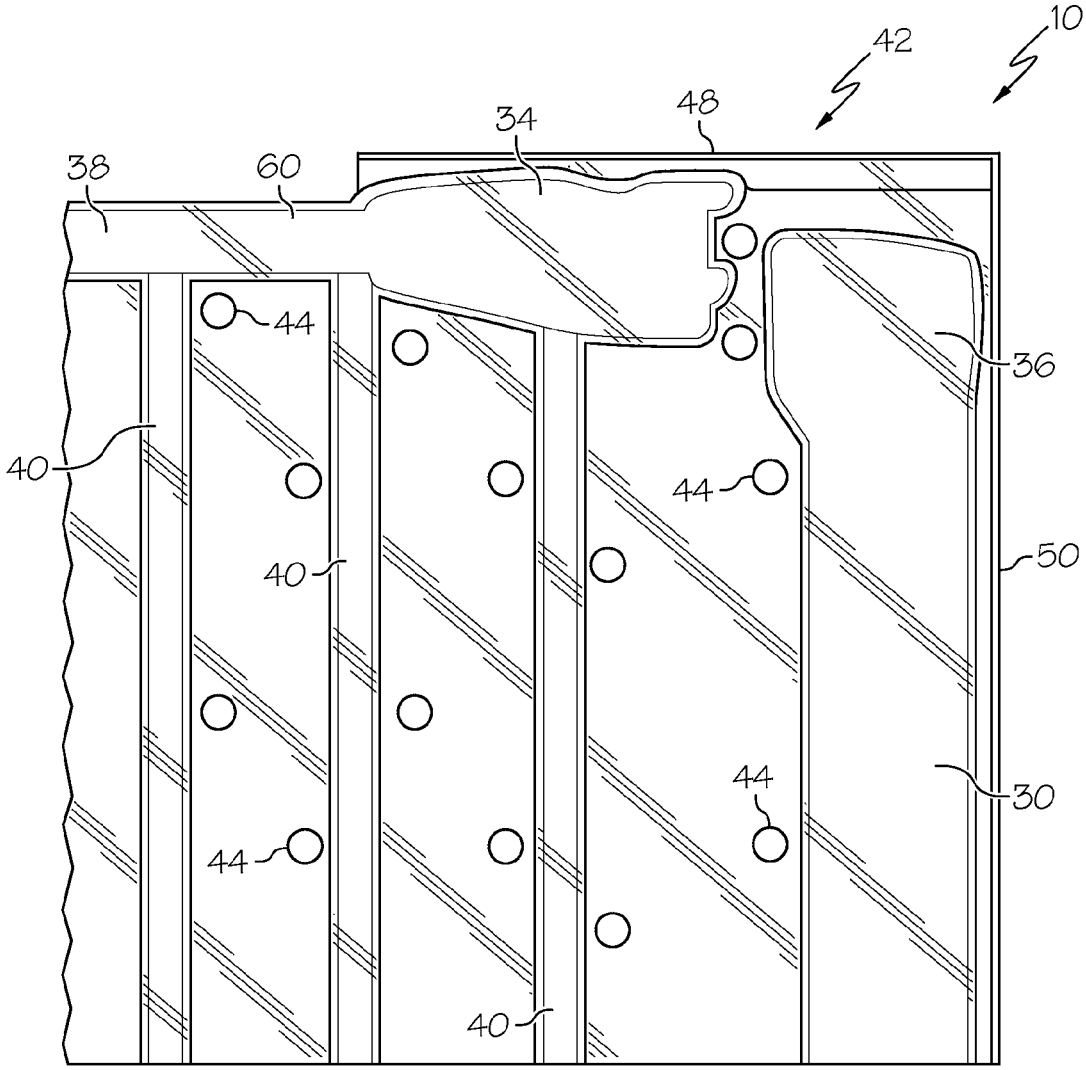
FIG. 5 is a fragmentary front elevational view of one component of the packaged gate system that is shown in FIG. 1.
Figure 6:
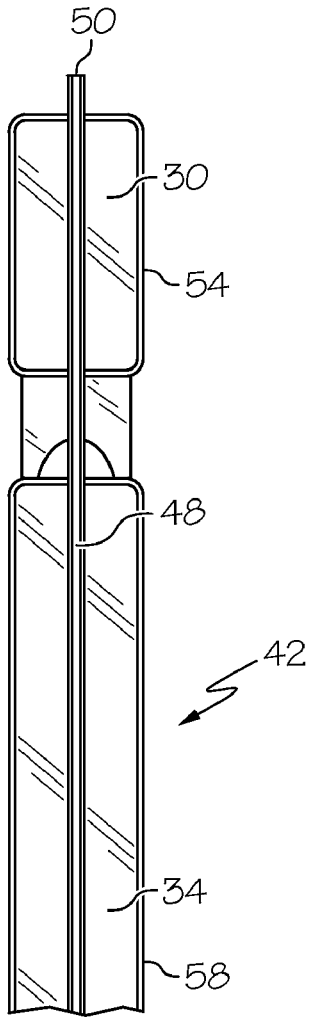
FIG. 6 is a fragmentary top plan view of a portion of the packaged gate system that is shown in FIG. 1.
Figure 7:
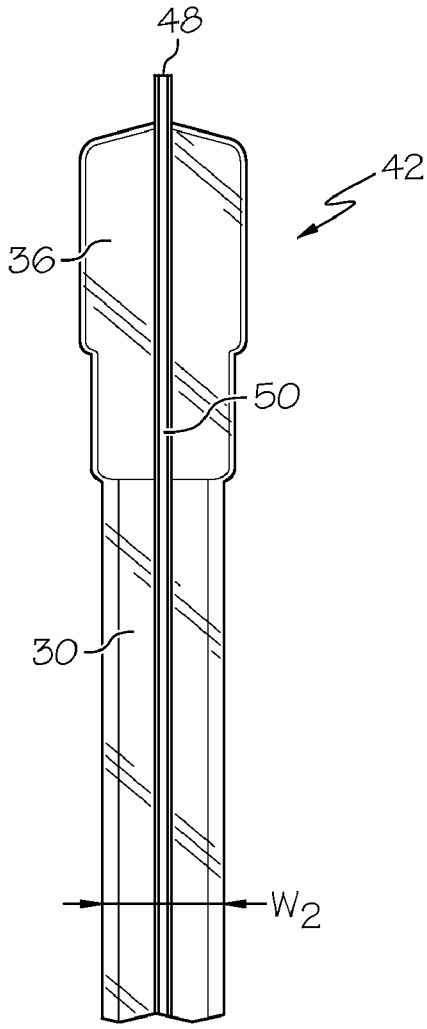
FIG. 7 is a fragmentary side elevational view of a portion of the packaged gate system that is shown in FIG. 1.

As is best shown in FIGS. 2-4, the insert 42 is preferably fabricated from a unitary sheet of transparent plastic material that is folded together into two halves. The fold line 52 between the two halves is included within a hinge projection 50 in a portion of the insert 42 that forms part of the first side surface 24. In the preferred embodiment, the hinge projection 50 has two hinged bows or wings and is substantial enough that it may be grasped by a consumer, although this is not the preferred method for grasping and pulling the packaged gate system 10. The upper surface of the insert 42 also preferably includes a projection 48 that is not a hinge but may also be grasped and pulled by a consumer.

The insert 42 further preferably includes a first gripping portion 54 that is molded to conform and fit closely about the vertical side post 30 of the gate 12. The first gripping portion 54 has a second maximum width $W_2$ that is preferably substantially within a range of about 0.3 inch to about 5.5 inches, more preferably within a range of about 0.8 inch to about 3.5 inches, and most preferably within a range of about 1.0 inch to about 2.0 inches.

The insert 42 also preferably has a second gripping portion 56 that in the preferred embodiment is immediately adjacent to and inward of the first gripping portion 54. The second portion 56 has a third width $W_3$ that is less than, and preferably substantially less than, the second width $W_2$. The third width $W_3$ is preferably substantially within a range of about 0.01 inch to about 4.0 inches, more preferably substantially within a range of about 0.05 inch to about 3.0 inches and most preferably substantially within a range of about 0.10 inch to about 2.0 inches.

Because the width of the second gripping portion 56 is less than that of the first gripping portion 54, a consumer will be able to wrap his or her fingers about the first gripping portion 54 in order to gain the necessary purchase to pull the packaged gate system 10 outwardly from the stack of like packaged gate systems 10. Accordingly, a portion of the insert 42 is shaped as an effective gripping handle that will make it easier for consumers to move the packaged gate system 10, especially when removing it from its retail display location.

Figure 8:
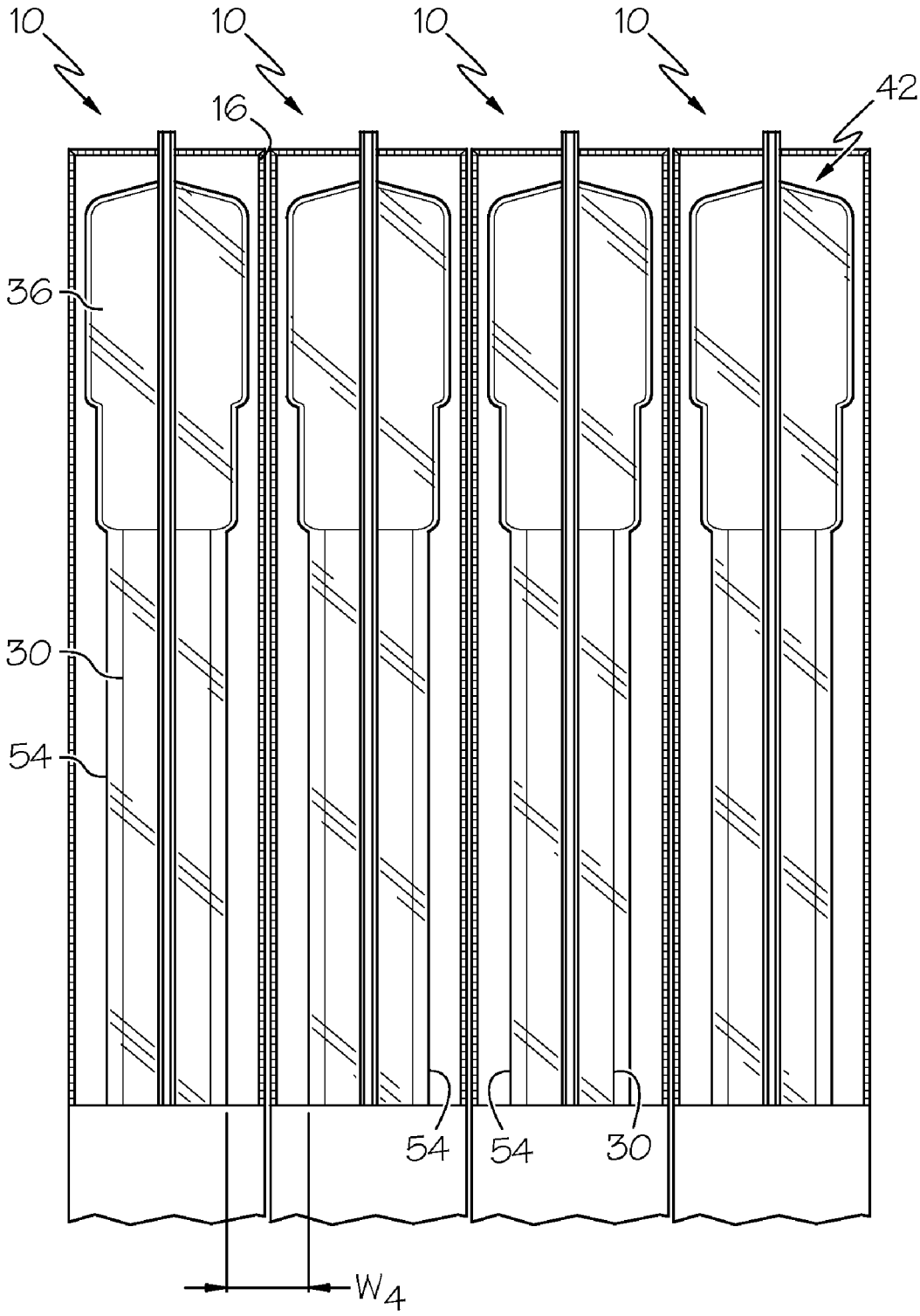
FIG. 8 is a fragmentary side elevational view showing a plurality of packaged gate systems according to the preferred embodiment stacked together vertically edgewise.

In addition, as is best shown in FIG. 8, because the maximum width $W_2$ of the first gripping portion 54 is less than the maximum width $W_1$ of the cardboard box 12, a clearance space having a width $W_4$ is created between like packaged gate systems 10 when they are stacked edgewise next to each other that will enable a consumer to be able to fit his or her fingers between the individual packaged gate systems 10 in order to be able to grip the first gripping portion 54 of one of the gate systems 10. Preferably, the width $W_4$ of the finger clearance space is substantially within a range of about 0.2 inch to about 3.0 inches, more preferably substantially within a range of about 0.25 inch to about 2.0 inches and most preferably substantially within a range of about 0.3 inch to about 1.5 inches.

Insert 42 is also preferably constructed so that the connecting mechanism 32 will be visible to a consumer through the insert 42, particularly when the packaged gate systems 10 are stacked edgewise with respect to each other. Specifically, the insert 42 also includes a third gripping portion 58 that is molded to closely conform to the outer dimensions of the first connector component 34, and the uppermost portion of the first gripping portion 54 is molded to closely conform to the outer dimensions of the second connector component 36 that is integral with the vertical side column 30.

In addition, insert 42 preferably includes a fourth gripping portion 60 that is molded to closely conform to the outer dimensions of the upper horizontal bar 38 of the gate 14.

Both the third gripping portion 58 and the fourth gripping portion 60 preferably have maximum widths that are substantially greater than the widths of adjacent portions of the insert 42, meaning that they can also be used as a gripping handle to assist a consumer in moving the packaged gate system 10. In the preferred embodiment, the width of these adjacent portions is preferably substantially the same as the third width $W_3$. In other words, the width of those portions 62 of the insert 42 that are not specifically configured to closely fit about structural components of the gate 14 is preferably substantially uniform.

Additionally, a plurality of snap connectors 44 are preferably molded into the portions 62 of the insert 42 that are not specifically configured to closely fit about the structural components of the gate 14, in order to hold the individual transparent plastic sheets that form the insert 42 together. As may be seen in the cross-sectional view that is provided in FIG. 4, each snap connector 44 includes a pair of mating indentations that are defined in the respective plastic sheets forming the insert 42. This creates a snap-fit between the indentations that permit the two halves of the insert 42 to be coupled by applying pressure, or uncoupled by pulling them apart. Alternatively, a plurality of spot welds could be used to tack the individual plastic sheets together, or an adhesive could be used. Staples or adhesive tape could also be used.

Each of the packaged gate systems 10 is preferably manufactured by separately fabricating the cardboard box 12, the gate 14 and the insert 42 according to known processes. For example, the insert 42 could be fabricated using a thermoforming process from an extruded sheet of transparent plastic material.

In the preferred embodiment, the insert 42 is assembled onto the corner of the gate 14 by folding it so that the first portion 54 conforms to the vertical post 30 of the gate 14, the third portion 58 conforms to the first connector component 34 and the fourth portion 60 conforms to the upper horizontal bar 38. The two halves of the insert 42 are then fastened together, preferably by coupling the snap connectors 44. The assembly consisting of the insert 42 and the gate 14 is then assembled with respect to the cardboard box 12 by sliding the assembly into an open side of the cardboard box 12 until the insert 42 is positioned in the orientation that is shown in FIGS. 1 and 2. The open side of the cardboard box is then closed and sealed to form the second side surface 26.

In a retail facility, the packaged gate systems 10 are designed to be stacked edgewise with respect to each other with their respective bottom surfaces 22 being supported on an underlying horizontal surface such as a retail shelf or floor so that the front surface 16 of one of the systems 10 is in close contact with and in substantial alignment with the rear surface 14 of an adjacent system 10. The first side surfaces 24 of the respective systems 10 are positioned to face the aisle or other location where the consumer is expected to encounter the packaged gate systems 10. In this orientation, valuable retail space is conserved without sacrificing the ability of the consumer to inspect important portions of the gate 14, namely the connecting mechanism 32 in the case of the preferred embodiment. By being able to view the connecting mechanism 32 through the transparent insert 42, the consumer will be better able to ascertain the quality and principal of operation of the connecting mechanism 32 and the gate 14.

When the consumer removes the packaged gate system 10 from its retail display location, he or she will be able to slip his or her fingers between the system 10 and the adjacent systems 10 in the stack as a result of the clearance that exists between the first gripping portions 54 of the respective systems 10. He or she will then be able to securely grip the first gripping portion 54 of the selected system 10 by getting his or her fingers behind it as a result of the width reduction that occurs between the first gripping portion 54 of the selected system 10 in the second gripping portion 56. The consumer will pull the selected system 10 toward his or herself, preferably by sliding it on the bottom surface 22 until it is removed from the stack, and then he or she may use other portions of the insert 42 such as the third portion 58 and the fourth portion 60 to lift the selected system 10 upwardly into a cart or trolley. The gripping locations are provided by the insert 42 may also be used by the consumer after the system 10 has been purchased in order to help move the system 10 to its final intended location.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A packaged gate system, comprising:

a gate;

a box having an interior space in which the gate is positioned, the box having front and rear major surfaces and at least one side surface that defines an edge of the box, the side surface having a first maximum width;

an opening defined in the side surface and in a portion of at least one of the front and rear surfaces;

an insert positioned in the opening, the insert being secured to at least one of the box and the gate, the insert having a second maximum width that is less than the first maximum width, whereby a space is defined to permit a person to grasp and move the packaged gate system.

2. A packaged gate system, comprising:

a gate;

a box having an interior space in which the gate is positioned, the box having front and rear major surfaces and at least one side surface that defines an edge of the box, the side surface having a first maximum width;

an opening defined in the side surface;

an insert positioned in the opening, the insert being secured to at least one of the box and the gate, the insert having a second maximum width that is less than the first maximum width, whereby a space is defined to permit a consumer to grasp and move the packaged gate system, wherein the box also has a top surface, and wherein the opening is defined in a corner of the box including an uppermost portion of the side surface and part of the top surface.

3. A packaged gate system according to claim 1, wherein the insert is fabricated from a material that is substantially transparent.

4. A packaged gate system according to claim 1, wherein the insert is secured to the gate.

5. A packaged gate system according to claim 1, wherein the opening is defined in portions of both of the front and rear surfaces.

6. A packaged gate system according to claim 1, wherein a portion of the insert is shaped to define a gripping handle.

7. A packaged gate system according to claim 6, wherein the portion of the insert that defines the gripping handle has a first portion that defines the second maximum width of the insert and a second portion having a third width that is less than the second maximum width, the second portion being inward of the first portion.

8. A packaged gate system according to claim 7, wherein the first portion of the insert is secured about a portion of the gate.

9. A packaged gate system according to claim 8, wherein the insert is fabricated from a material that is substantially transparent, whereby the portion of the gate is visible to a person through the insert.

10. A packaged gate system according to claim 3, wherein the gate has a connecting mechanism that is visible through the insert.

11. A packaged gate system according to claim 1, wherein the box is fabricated from a material including cardboard.

12. A packaged gate system according to claim 1, wherein the insert includes an outwardly facing hinge portion.

13. A packaged gate system, comprising:

a gate;

a box having an interior space in which the gate is positioned, the box having front and rear major surfaces and at least one side surface that defines an edge of the box;

an opening defined in the side surface and in a portion of at least one of the front and rear surfaces;

a transparent insert positioned in the opening, the insert being secured to a portion of the gate, whereby the portion of the gate is visible to a consumer when the packaged gate system is stacked edgewise with the side surface facing the consumer.

14. A packaged gate system, comprising:

a gate;

a box having an interior space in which the gate is positioned, the box having front and rear surfaces and at least one side surface that defines an edge of the box;

an opening defined in the side surface;

a transparent insert positioned in the opening, the insert being secured to a portion of the gate, whereby the portion of the gate is visible when the packaed gate system is stacked edgewise, wherein the box also has a top surface, and wherein the opening is defined in a corner of the box including an uppermost portion of the side surface and part of the top surface.

15. A packaged gate system according to claim 13, wherein the opening is defined in portions of both of the front and rear surfaces.

16. A packaged gate system according to claim 13, wherein a portion of the insert is shaped to define a gripping handle.

17. A packaged gate system according to claim 13, wherein the gate has a connecting mechanism that is visible through the insert.

18. A packaged gate system according to claim 13, wherein the box is fabricated from a material including cardboard.

19. A packaged gate system according to claim 13, wherein the insert includes an outwardly facing hinge portion.

20. A packaged gate system, comprising:

a gate;

a box having an interior space in which the gate is positioned, the box having front and rear major surfaces, a bottom surface, a top surface and a side surface that defines an edge of the box;

an opening defined in an uppermost portion of the side surface, a portion of the top surface and a portion of both of the front and rear major surfaces;

a transparent insert positioned in the opening, the insert being secured to at least one of the box and a portion of the gate, whereby the portion of the gate will be visible to a person when the packaged gate system is stacked edgewise together with like packaged gate systems on the bottom surface with the side surface facing the person.

21. A packaged gate system according to claim 20, wherein a portion of the insert is shaped to define a gripping handle.

22. A packaged gate system according to claim 20, wherein the gate has a connecting mechanism that is visible through the insert.

23. A packaged gate system according to claim 20, wherein the box is fabricated from a material including cardboard.

24. A packaged gate system according to claim 20, wherein the insert is secured to a portion of the gate.

25. A packaged gate system according to claim 21, wherein the portion of the insert that defines the gripping handle has a first portion that defines a second maximum width of the insert and a second portion having a third width that is less than the second maximum width, the second portion being inward of the first portion.

26. A packaged gate system according to claim 25, wherein the first portion of the insert is secured about a portion of the gate.

27. A packaged gate system according to claim 20, wherein the gate has a hinge assembly that is visible through the insert.

* * * * *